US005241914A

United States Patent [19]

Korb

[11] Patent Number: 5,241,914

[45] Date of Patent: Sep. 7, 1993

[54] WORK TABLE OR OFFICE DESK

[75] Inventor: Daniel Korb, Sindelfingen, Fed. Rep. of Germany

[73] Assignee: Dyes GmbH Büromöbelfabrik, Fed. Rep. of Germany

[21] Appl. No.: 755,370

[22] Filed: Sep. 6, 1991

[30] Foreign Application Priority Data

Sep. 7, 1990 [DE] Fed. Rep. of Germany ..... 4028454

[51] Int. Cl.[5] ..... A47F 5/12

[52] U.S. Cl. ..... 108/7; 108/147; 248/188.1

[58] Field of Search ..... 108/147, 4, 1, 3, 6, 108/9, 10, 7, 153, 156, 157, 155; 248/188.1, 188.8

[56] References Cited

U.S. PATENT DOCUMENTS 4,615,279 10/1986 de la Haye ..... 108/7 X
4,711,184 12/1987 Wallin et al. ..... 108/147 X
4,748,913 6/1988 Favaretto et al. ..... 108/50
4,944,235 7/1990 Jahnke et al. ..... 108/157
4,966,341 10/1990 Borsani ..... 108/153 X

FOREIGN PATENT DOCUMENTS 0396179 11/1990 European Pat. Off. ..... 248/188.1
2046487 5/1971 Fed. Rep. of Germany ..... 108/7

*Primary Examiner*—Jose V. Chen
*Attorney, Agent, or Firm*—Speckman, Pauley & Fejer

[57] ABSTRACT

A work table or office desk with a work surface which is adjustable in height or inclination, and is supported by two pairs of pivotal support arms on the cross piece of a table support. One pair of support arms is oriented towards the front and the other pair of the support arms towards the back of the work surface. The support arms are hinged on sliders which are adjustable in guide rails extending from the front to the back, on the underside, of the work surface. A simple drive device, which can be integrated into the support arms, provides numerous possibilities for changing the height and/or inclination of the work surface.

23 Claims, 3 Drawing Sheets 11
12
15
16
50
18
14
42
40
44
47
48
39
38
45
49
46
35
27
34
33
53
30

WORK TABLE OR OFFICE DESK

BACKGROUND OF THE INVENTION

1. Field of the Invention

This invention relates to a work table or office desk with a work surface which is adjustable in height or inclination and is supported by two pairs of pivotal support arms on a cross piece of the table support. One pair of support arms is oriented towards the front and the other pair of the support arms towards the back of the work surface and is hinged there on sliders. The sliders are adjustable in guide rails extending from the front to the back on the underside of the work surface, where one convexly curved and arc shaped bar for each support arm is positioned on the long sides of the cross piece. The support arms are pivotal by means of a drive having a toothed drive gear.

2. Description of Prior Art

A work table or office desk of this type is known from German Patent Application DE-OS 39 33 237. The table support has two side walls, the upper ends of which are connected with each other by the cross piece. One end of the support arms is hinged on the cross piece, while the other end is hingedly supported on the work surface or on the guide rails. Threaded rods are provided as drive elements, on which the connecting blocks are adjustable in pairs or together. Such efforts are only acceptable if it is often necessary to adjust the height and/or inclination of the work surface.

In this known work table or office desk, the long sides of the tub-shaped cross piece are hollow bodies. It is furthermore known to shape a dove-tailed guide bar in a U-shape. The inclusion of a worm gear engaging a worm shaft into the drive for the support arms can also be inferred from this state of the art. The support arms taper towards the ends oriented towards the work surface and end in hinged brackets in order to fasten the support arms on the work surface in a hinged manner.

A work table or office desk with pairs of support arms for the work surface is also known from German Patent Application DE-OS 30 39 180. The support arms, which are height-adjustable in pairs, can be pivoted together or in pairs for changing the height and/or inclination of the work surface. Drive elements with threaded rods and threaded blocks are used to pivot the support arms, as well as tongs formed with two levers. This outlay of drive elements is increased by coupling elements which are required for the simultaneous pivoting of the pair of support arms associated with one side of the work surface. Such an effort is only justified if it is often necessary to adjust the height and/or inclination of the work surface. The design of such support arms is not advantageous.

Additionally, further characteristics are required for this known work table or office desk, to assure that the pivoted position of the support arms on the cross piece is secure. Additional guide arms or drive devices in the area of the table support are required for such arrangement.

SUMMARY OF THE INVENTION

It is one object of this invention to provide a simple drive for the support arms of a work table or office desk of the type previously described which only requires simple parts on the table support as well as on the work surface, and which can be positioned in such a way that it does not adversely affect the aesthetic appearance of the work table or office desk.

In accordance with one preferred embodiment of this invention, such object is achieved with bars formed as dove-tailed guide bars having at least one tooth. Each support arm is constructed from two shell-shaped support arm halves and forms, in the direction towards the cross piece, a concave and curved partial dove-tailed guide groove in the shape of an arc, which encloses the dove-tailed guide bar and fixes the support arm in a pivotal manner on the dove-tailed guide bar. Each support arm receives a self-locking drive which can be driven by a drive shaft and which engages with the at least one tooth of the dove-tailed guide bar through at least one toothed drive gear.

It is only necessary to fasten the dove-tailed guide bars on the table support. The support arm contains the entire drive for each support arm, so that only the access to the drive shaft is visible. The drive shafts of the support arms can be arbitrarily coupled and thus it is possible to attain the different adjustment possibilities of the work surface. The pivoted seating of the support arms on the table support is improved, since a large area is supported during the entire pivot movement of the support arms. In this case, the ends of the support arms facing the cross piece can completely cover the dove-tailed guide bars, so that an aestethically pleasant shape of the transition between the cross piece and the support arms is achieved. Additionally, this transition is also adapted to the pivot movement and is optimized since the dove-tailed guide bar is formed in a U-shape, where the lateral legs pass over into bar ends which are bent outwardly at right angles. Two teeth are positioned between the lateral legs of the dove-tailed guide bars, which are engaged with two toothed drive gears that are fixed against relative rotation on a drive shaft rotatably seated in the support arm halves.

The connection between the cross piece and the dove-tailed guide bars is more stabilized with the long sides of the tub-shaped cross piece having side walls in the form of hollow sections into which insertion connectors can be inserted. The dove-tailed guide bars are connected with the inserted insertion connectors through the side walls of the cross piece, for example by a screwed connection.

According to one embodiment of this invention, the drive inside the support arm is designed in such a way that a worm gear, which engages a worm fixed against relative rotation on a worm shaft rotatably seated in the support arm halves, is fixed against relative rotation on the take-off shaft between the two toothed take-off gears. The worm shaft supports a toothed belt wheel, which is in effective connection through an endless toothed belt with a toothed belt drive wheel. The toothed belt drive wheel is fixed against relative rotation on the drive shaft, which is rotatably seated in the area of the end of the support arm facing the work surface and is accessible from the outside of the support arm. Because the drive shafts are positioned in the areas of the support arms facing the work surface, they can be easily operated, manually.

According to another preferred embodiment of this invention, the support of the support arms on the dove-tailed guide bars is improved since two support rollers are rotatably seated in the support arm halves, which extend into the dove-tailed guide grooves on both sides of the toothed take-off wheels, and are supported on the front faces of the bar ends of the dove-tailed guide bar.

For the required pivot bearings, the drive shaft, take-off shaft and worm shaft are seated in sleeve-like bearing necks of the support arm halves, where the drive shaft extends out of the support arm on at least one end with a coupling section.

In accordance with another embodiment of this invention, the construction of the support arm is such that the rotational shafts of the drive shaft, the take-off shaft and the support rollers are oriented parallel to each other and parallel to the longitudinal axis of the cross piece as well as vertically to the plane of separation of the support arm halves. The drive shaft and the take-off shaft are positioned in a central plane of the support arm which is vertically oriented with respect to the plane of separation. The support rollers are located symmetrically with respect to such central plane.

For aesthetic reasons, the support arms can taper towards the ends facing the work surface and can have hinged brackets.

The drive can be simplified with each of the drive shafts of the support arms corresponding to the front and the drive shafts of the support arms corresponding to the back of the work surface connected with each other by means of a coupling rod, in a manner fixed against relative rotation and can be jointly driven, since in this embodiment the pairs of support arms are always jointly pivoted.

If the coupling rods are individually and selectively drivable in one or the other rotational direction, it is possible to selectively raise or lower the front or the back of the work surface.

If, however, the coupling rods are jointly and selectively drivable in one or the other rotational direction, then the entire work surface can be selectively raised or lowered. This can also be selectively done by means of the individual drive of the coupling rods.

Finally, it is also possible for the coupling rods to be drivable jointly and individually in the same or opposite rotational directions. It is thus possible to achieve opposite movements of the front and the back of the work surface.

This invention will be described in detail in accordance with one preferred embodiment shown in the drawings.

DESCRIPTION OF PREFERRED EMBODIMENTS

Figure 1:
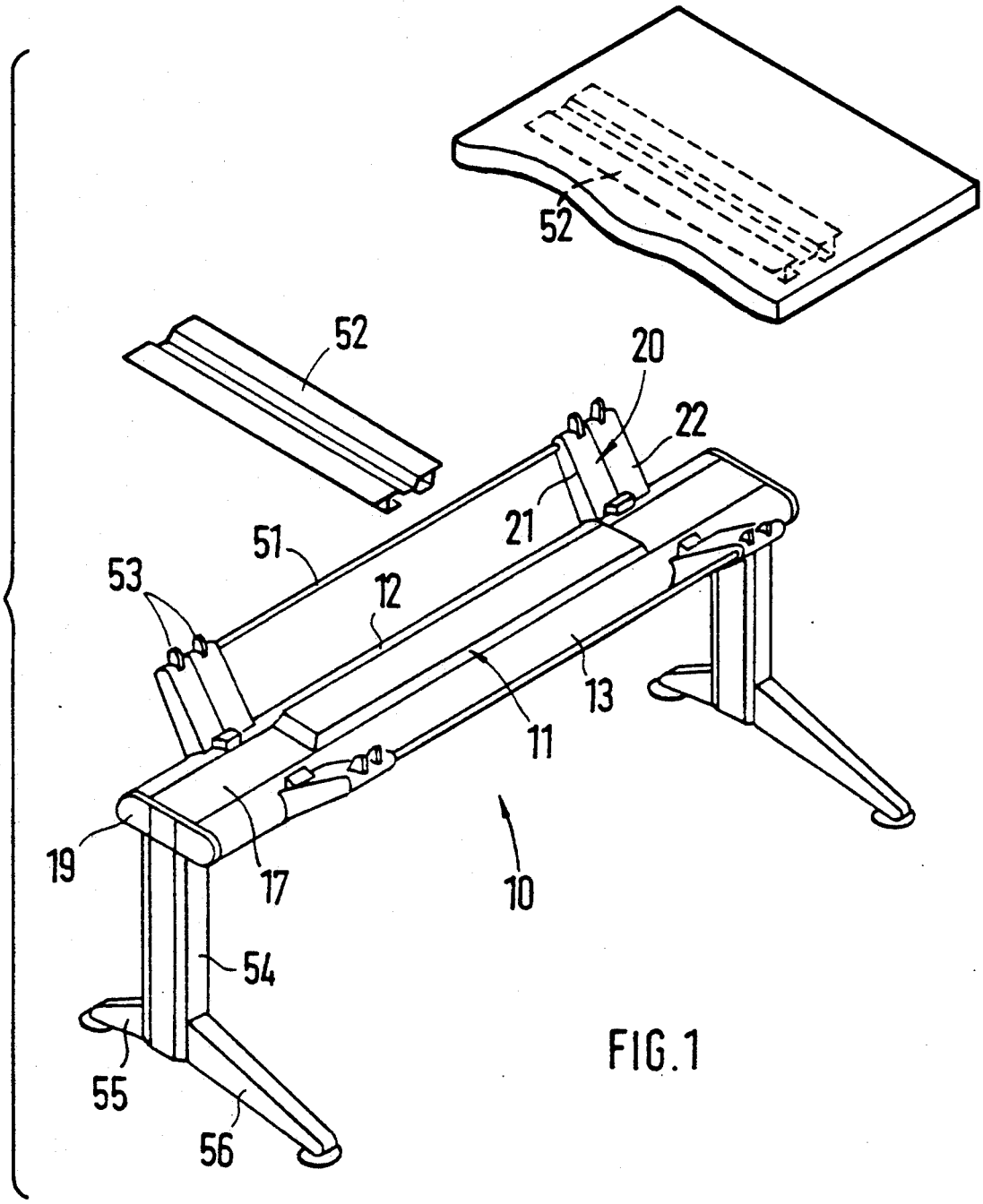
FIG. 1 is a perspective view of a table support of a work table or office desk having four support arms.

The table support 10 of a work table or office desk is shown in a perspective front view in FIG. 1. The cross piece 11 rigidly connects the upper ends of the table legs 54 with each other. The short foot elements 55 are fastened, oriented towards the back of the work table or office desk, at the lower ends of the lateral table legs 54, while the long foot elements 56 extend towards the front. The front faces of the cross piece 11 are closed off with covers 19.

The work surface, shown in FIG. 1, supports on its underside the guide rails 52 oriented from the front to the back, in which sliders are adjustably guided. These sliders are hingedly connected with the hinged brackets 53, which are formed on the facing ends of the four support arms 20. As shown by the coupling rods 51, the two support arms 20 of the front and the two support arms 20 of the back are each connected to form a pair of jointly pivotal support arms 20. On its longitudinal edges, the cross piece 11 has side walls 12 and 13 in the form of hollow sections, on which dove-tailed guide bars are fastened for the pivotal seating of the support arms 20, as will be described below. The cross piece 11 forms a cable channel with the two side walls 12 and 13, which can be closed by means of the lid 17. Each of the support arms 20 is put together from the two shell-shaped support arm halves 21 and 22, which receive an individually drivable, self-locking drive.

Figure 2:
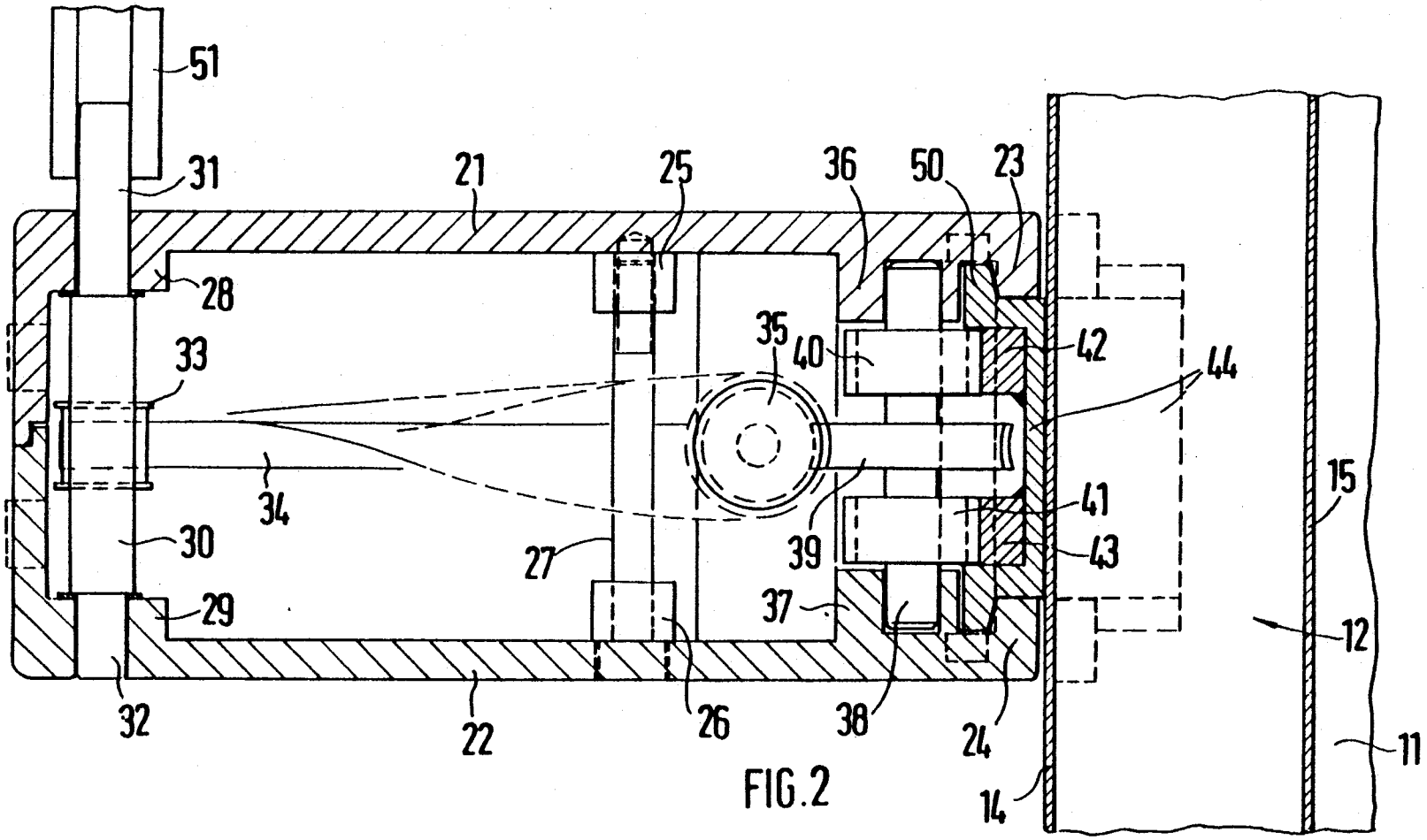
FIG. 2 is a sectional view of a support arm with an individual drive extending vertically to the plane of separation of the two halves of the support arm.
Figure 3:
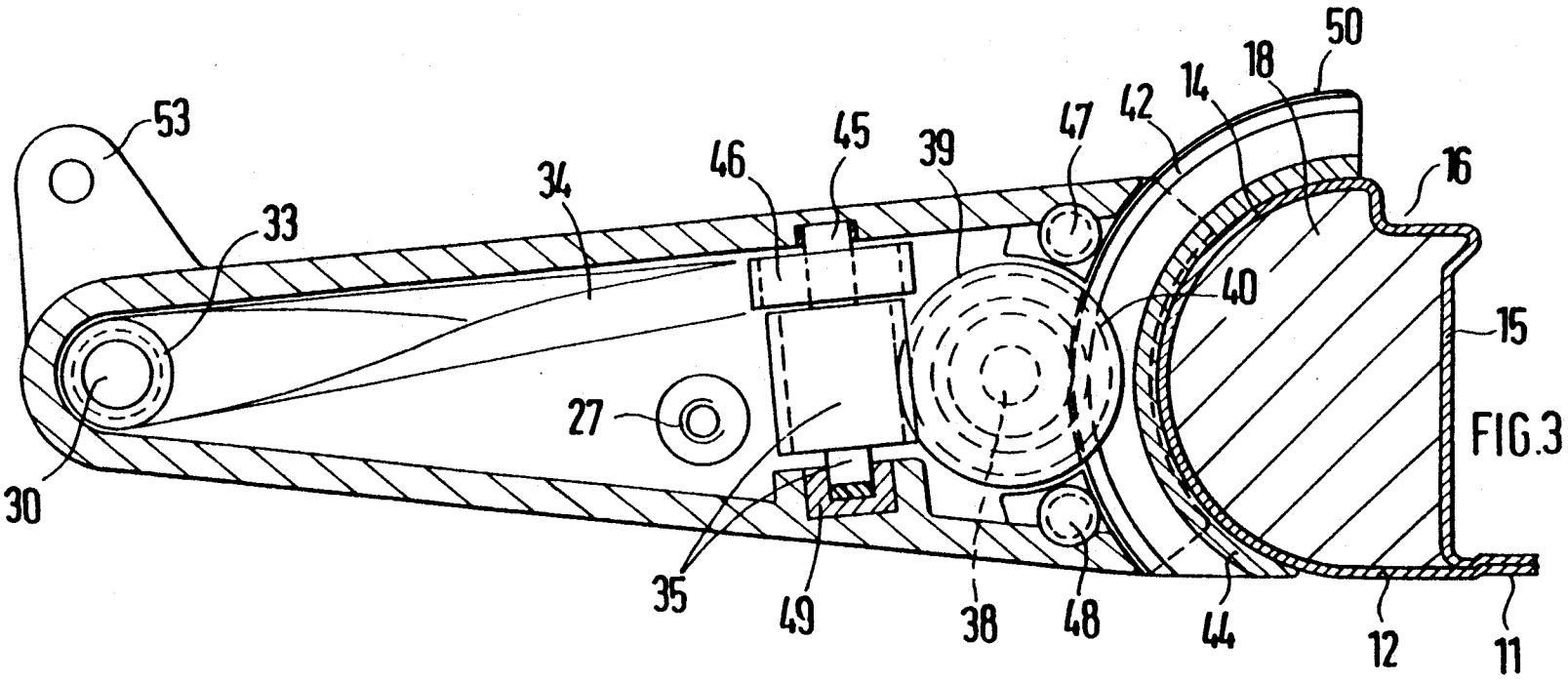
FIG. 3 is a sectional view parallel to the plane of separation of the support arm halves.

The two sectional views in accordance with FIGS. 2 and 3 show the installation of the support arms 20 on the cross piece 11 as well as the structure of the drive for pivoting the support arm 20, which is integrated into the support arm 20. Insertion connectors 18, which extend as far as the connecting points of the support arms 20, are inserted into the front of the side walls 12 and 13, which are in the form of hollow sections. The cross section of the insertion connectors 18 is adapted to the cross section of the hollow sections. In the embodiment shown in FIGS. 2 and 3, hollow sections having a semicircular cross section are formed. The convexly curved sections 14 are facing outward in this particular embodiment, while the straight, vertical sections 15 laterally limit the cable channel. The transition areas from the convexly curved sections 14 to the straight vertical section 15 are shaped to form an offset connecting section 16 in the area of the open, upper side of the cross piece 11 and lockingly receive a connecting bar or a connecting spring of the lid 17. As the sectional view of FIG. 3 shows, the cross piece 11 can be constructed of one piece in the shape of a sheet metal section.

The dove-tailed guide bars 44 are fastened on the convexly curved section 14, preferably with fastening screws that extend through the side walls 12 and 13, and are mated within threaded receivers or insertion connectors 18. The dove-tailed guide bars 44 are convex and curved in the shape of an arc, so that they provide a pivot path for the support arms 20. The support arm halves 21 and 22 face each other with their open sides and thus form a receiving chamber for the drive and terminate in the direction of the cross piece 11 in dove-tailed guide grooves 23 and 24, which enclose the dove-tailed guide bar 44 with the bar ends 50 on its lateral arms. The two correspondingly extending teeth 42 and 43, which are inserted into or formed as one piece with the dove-tailed guide bar 44, extend between and following after the lateral arms of the dove-tailed guide bar 44.

The toothed gears 40 and 41, which are mounted on and fixed against relative rotation with respect to the take-off shaft 38, engage with the two teeth 42 and 43. The take-off shaft 38 is rotatably mounted in the sleeve-like bearing necks 36 and 37 of the support arm halves 21 and 22. Between the two toothed gears 40 and 41, the take-off shaft 38 supports the worm gear 39, which is fixed against relative rotation and engages with the worm 35. The worm 35 is mounted on and fixed against relative rotation with respect to the bearing shaft 45. Bearing shaft 45 is rotatably seated, at least partially by means of bearing bushings 49, in the support arm halves 21 and 22. Besides the worm 35, the bearing shaft 45 supports the toothed belt wheel 46 in a manner fixed against relative rotation. The drive shaft 30 with the toothed belt drive wheel 33 is rotatably seated in the ends of the support arms 20, facing the work surface, in the bearing necks 28 and 29. As shown by the ends of the drive shaft 30, it can be operated from outside of the support arm 20. The bearing section 32 in the embodiment shown in FIG. 2 is flush with the support arm half 22, while the other end extends outside of the support arm half 21 as a coupling section 31 and can be used for connection with the coupling rod 51. The toothed belt drive wheel 33 is in effective contact with the toothed belt wheel 46 through transmission of the endless toothed belt 34. The two support rollers 47 and 48 are seated in the support arm halves 21 and 22 for improved support and guidance of the support arm 20 in such a way, that they protrude on both sides of the toothed wheels 40 and 41 and are supported on the fronts of the bar ends 50 of the dove-tailed guide bar 44.

The two support arm halves 21 and 22 are connected with each other by connecting bolts 27, which are mounted within screw sockets 26 of the support arm half 22 and are screwed into screw necks 25 of the support arm half 21.

This drive is self-locking because of the great reduction achieved by the worm 35 and the worm gear 39, so that the drive is not operating in the lowering direction, even when the work surface is loaded down.

The pairs of support arms 20 can be operated individually or jointly with the coupling rods 51. The coupling rods 51 can be operated in two rotational directions. Thus, it is possible to raise or lower only the front of the work surface or only the back of the work surface. During simultaneous operation of the two coupling rods 51 it is possible to raise or lower the work surface regardless of its selected inclination. Even an opposite displacement of the front and back of the work surface is possible simply by a simultaneous, but opposite, pivoting of the support arms 20.

We claim:

1. In a work table or office desk having a work surface which is adjustable in at least one of height and inclination, which is supported by two pairs of pivotal support arms on a cross piece of the table support, one pair of the support arms being oriented towards a front of the work surface, the other pair of the support arms being oriented towards a back of the work surface, wherein the work surface is slidably adjustable with respect to corresponding guide rails that extend from the front to the back of the work surface, one convexly curved guide bar per each of the support arms positioned on long sides of the cross piece, and the support arms being pivotal by means of a drive having a toothed drive gear, the improvement comprising:

each of the convexly curved guide bars (44) having at least one tooth (42, 43);

each support arm (20) comprising two shell-shaped support arm halves (21, 22), in a direction towards the cross piece (11) each of the support arm halves (21, 22) forming a concavely curved guide groove (23, 24) enclosing the corresponding guide bar (44) for pivotally mounting the support arm (20) on the guide bar (44); and each of the support arms (20) receiving a locking drive driven by a take-off shaft (38), said locking drive engaging at least one toothed take-off gear (40, 41) with at least one tooth (42, 43) secured to the guide bar (44), and each said toothed take-off gear being mounted to and fixed against relative rotation with respect to the take-off shaft (38).

2. In a work table or office desk in accordance with claim 1, wherein the cross piece (11) has a tub shape, the long sides of the cross piece (11) have a plurality of side walls (12, 13) formed as hollow sections, a plurality of insertion connectors (18) are insertable within the hollow sections, and the guide bars (44) are mated with the insertion connectors (18) through the side walls (12, 13).

3. In a work table or office desk in accordance with claim 2, wherein each of the guide bars (44) has an overall U-shape formed by two lateral legs which each merge into a bar end (50) which is directed outwardly at right angles with respect to the lateral legs, two teeth of the at least one tooth (42, 43) are positioned between the lateral legs of the guide bars (44) which engage with two toothed take-off gears of the at least one toothed take-off gear (40, 41), and the take-off shaft (38) is rotatably mounted in the support arm halves (21, 22).

4. In a work table or office desk in accordance with claim 3, wherein a worm gear (39) engages a worm (40) mounted on and secured against rotation with respect to a worm shaft (35) rotatably mounted in the support arm halves (21, 22), the worm gear (39) is mounted on and secured against rotation with respect to the take-off shaft (38) between the toothed take-off gears (40, 41), the worm shaft (35) supports a toothed belt wheel (46) which is in effective connection with a tooted belt drive wheel (33) through transmission of an endless toothed belt (34), the toothed belt drive wheel (33) is mounted on and secured against rotation with respect to a drive shaft (30), the drive shaft (30) is rotatably mounted in an end area of the support arm (20) facing the work surface, and one end of the drive shaft (30) extends outside of the support arm (20).

5. In a work table or office desk in accordance with claim 4, further comprising two support rollers (47, 48) rotatably mounted in the support arm halves (21, 22) and extending into the guide grooves (23, 24) on both sides of the toothed take-off gears (40, 41), and each of the support rollers (47, 48) being supported on front faces of the bar ends (50) of the guide bar (44).

6. In a work table or office desk in accordance with claim 5, wherein the drive shaft (30), the take-off shaft (38) and the worm shaft (35) are mounted in sleeve bearing necks (28, 29; 36, 37) of the support arm halves (21, 22).

7. In a work table or office desk in accordance with claim 6, wherein the end of the drive shaft (30) that extends out of the support arm (20) has a coupling section (31).

8. In a work table or office desk in accordance with claim 7, wherein rotational shafts of the drive shaft (30), the take-off shaft (38) and the support rollers (47, 48) are oriented parallel to each other and parallel to a longitudinal axis of the cross piece (11) and vertically to a plane of separation of the support arm halves (21, 22).

9. In a work table or office desk in accordance with claim 8, wherein the drive shaft (30) and the take-off shaft (38) are positioned in a central plane of the support arm (20) which is vertically oriented with respect to the plane of separation, and the support rollers (47, 48) are positioned symmetrically with respect to the central plane.

10. In a work table or office desk in accordance with claim 9, wherein the support arms (20) taper towards ends of the support arms (20) facing the work surface, and a plurality of hinged brackets (53) are secured to the support arms (20).

11. In a work table or office desk in accordance with claim 10, further comprising a coupling rod (51) connecting each of the drive shafts (30) corresponding to the front of the work surface with the drive shafts (30) corresponding to the back of the work surface, and the coupling rod (51) being secured against relative.

12. In a work table or office desk in accordance with claim 11, wherein the coupling rods (51) are individually rotatable in either rotational direction.

13. In a work table or office desk in accordance with claim 11, wherein the coupling rods (51) are jointly and rotatable in either rotational direction.

14. In a work table or office desk in accordance with claim 11, wherein the coupling rods (51) are jointly and rotatable in opposite rotational directions.

15. In a work table or office desk in accordance with claim 1, wherein each of the guide bars (44) has an overall U-shape formed by two lateral legs which each merge into a bar end (50) which is directed outwardly at right angles with respect to the lateral legs, two teeth of the at least one toothed (42, 43) are positioned between the lateral legs of the guide bars (44) which engage with two toothed take-off gears of the at least one toothed take-off gear (40, 41), and the take-off shaft (38) is rotatably mounted in the support arm halves (21, 22).

16. In a work table or office desk in accordance with claim 1, wherein a worm gear (39) engages a worm (40) mounted on and secured against rotation with respect to a worm shaft (35) rotatably mounted in the support arm halves (21, 22), the worm gear (39) is mounted on and secured against rotation with respect to the take-off shaft (38) between the toothed take-off gears (40, 41), the worm shaft (35) supports a toothed belt wheel (46) which is in effective connection with a toothed belt drive wheel (33) through transmission of an endless toothed belt (34), the toothed belt drive wheel (33) is mounted on and secured against rotation with respect to a drive shaft (30), the drive shaft (30) is rotatably mounted in an end area of the support arm (20) facing the work surface, and one end of the drive shaft (30) extends outside of the support arm (20).

17. In a work table or office desk in accordance with claim 1, further comprising two support rollers (47, 48) rotatably mounted in the support arm halves (21, 22) and extending into the guide grooves (23, 24) on both sides of the toothed take-off gears (40, 41), and each of the support rollers (47, 48) supported on front faces of bar ends (50) which extend outwardly from lateral legs of the guide bar (44), wherein the guide bar (44) has an overall U-shape.

18. In a work table or office desk in accordance with claim 1, wherein a drive shaft (30), the take-off shaft (38) and a worm shaft (35) are mounted in sleeve bearing necks (28, 29; 36, 37) of the support arm halves (21, 22).

19. In a work table or office desk in accordance with claim 1, wherein at least one end of a drive shaft (30) which is rotatably mounted in an end area of the support arm (20) extends out of the support arm (20) with a coupling section (31).

20. In a work table or office desk in accordance with claim 1, wherein rotational shafts of a drive shaft (30), the take-off shaft (38) and a plurality of support rollers (47, 48) are oriented parallel to each other and parallel to a longitudinal axis of the cross piece (11) and vertically to a plane of separation of the support arm halves (21, 22).

21. In a work table or office desk in accordance with claim 1, wherein a drive shaft (30) and the take-off shaft (38) are positioned in a central plane of the support arm (20) which is vertically oriented with respect to a plane of separation of the support arm halves, and a plurality of support rollers (47, 48) are positioned symmetrically with respect to the central plane.

22. In a work table or office desk in accordance with claim 1, wherein the support arms (20) taper towards ends of the support arms (20) facing the work surface, and a plurality of hinged brackets (53) are secured to the support arms (20).

23. In a work table or office desk in accordance with claim 1, further comprising a plurality of drive shafts (30), a coupling rod (51) connecting each of the drive shafts (30) corresponding to the front of the work surface with the drive shafts (30) corresponding to the back of the work surface, and the coupling rod (51) being secured against relative rotation.

* * * * *